US008011335B2

(12) United States Patent
Park et al.

(10) Patent No.: US 8,011,335 B2
(45) Date of Patent: Sep. 6, 2011

(54) CONTINUOUS VARIABLE VALVE LIFT APPARATUS

(75) Inventors: Sung Bong Park, Seoul (KR); Bosung Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 606 days.

(21) Appl. No.: 12/130,561

(22) Filed: May 30, 2008

(65) Prior Publication Data

US 2009/0151674 A1 Jun. 18, 2009

(30) Foreign Application Priority Data

Dec. 14, 2007 (KR) ..... 10-2007-0131569

(51) Int. Cl.
*F01L 1/34* (2006.01)

(52) U.S. Cl. ..... 123/90.16; 123/90.44

(58) Field of Classification Search ..... 123/90.16, 123/90.2, 90.44, 90.39, 90.52, 90.17, 90.45, 123/90.15

See application file for complete search history.

(56) References Cited

U.S. PATENT DOCUMENTS

| | | | | |
|---|---|---|---|---|
| 4,881,498 | A * | 11/1989 | Matsuura et al. | 123/90.39 |
| 5,189,998 | A * | 3/1993 | Hara | 123/90.16 |
| 6,591,798 | B2 * | 7/2003 | Hendriksma et al. | 123/90.16 |
| 7,261,074 | B2 * | 8/2007 | Kim et al. | 123/90.16 |
| 7,640,900 | B2 * | 1/2010 | Tateno et al. | 123/90.16 |
| 2005/0028765 | A1 * | 2/2005 | Schon et al. | 123/90.16 |

FOREIGN PATENT DOCUMENTS

| | | | |
|---|---|---|---|
| JP | 2007-170333 | A | 7/2007 |
| KR | 10-2005-0105995 | A | 11/2005 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A valve lift may be continuously varied by an apparatus that includes: an input cam provided on an input shaft; a mediating lever that moves upwards or downwards by the input cam and is formed with an output cam; a valve unit operated by the output cam; and a control device that is coupled to the mediating lever and is capable of changing a contact point between valve unit and the output cam of the mediating lever.

9 Claims, 4 Drawing Sheets

(a)

(b)

(a)

(b)

CONTINUOUS VARIABLE VALVE LIFT APPARATUS

CROSS-REFERENCE TO RELATED APPLICATION

This application claims priority to and the benefit of Korean Patent Application No. 10-2007-0131569 filed in the Korean Intellectual Property Office on Dec. 14, 2007, the entire contents of which are incorporated herein by reference.

BACKGROUND OF THE INVENTION (a) Field of the Invention

The present invention relates to an engine, and more particularly, to a continuously variable valve lift apparatus of an engine.

(b) Description of the Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables different valve lifts depending on the engine speed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a continuously variable valve lift apparatus having advantages of enabling a continuously variable valve lift by a simple scheme.

An exemplary embodiment of the present invention provides a continuously variable valve lift apparatus that includes: an input cam provided on an input shaft; a mediating lever that reciprocally moves by the input cam and is formed with an output cam; a valve unit operated by the output cam; and a control device that is coupled to the mediating lever and is capable of changing a contact point between valve unit and the output cam of the mediating lever.

The control device may include: a control shaft that is arranged substantially in parallel with the input shaft and is coupled to the mediating lever through at least a connecting groove such that the mediating lever is drawn back or forth by a rotation of the control shaft; and a control unit that controls a rotation angle of the control shaft.

The connecting groove may be eccentrically biased from a rotation center of the control shaft.

The valve unit may comprise a swing arm having an oval profile at a surface for contacting the output cam of the mediating lever.

A contact point between the swing arm and the output cam for a low lift may be closer to the control shaft than a contact point between the swing arm and the output cam for a high lift is.

Another exemplary embodiment of the present invention provides a continuously variable valve lift apparatus that includes: an input cam coaxially provided on an input shaft; a mediating lever comprising contact portion, output cam, and at least a pivot portion wherein the input cam contacts on the contact portion, and the contact portion and the output cam rotates pivotally with respect to the pivot portion in response to rotation of the input cam; a valve unit operated by the output cam of the mediating lever, comprising a pivot part, wherein the pivot part is positioned opposite to the pivot portion of the mediating lever with respect to rotation axis of the input shaft; and a control device that is coupled to the pivot portion of the mediating lever and changes a contact point between valve unit and the output cam of the mediating lever.

The control device may comprise: a control shaft that is arranged in parallel with the input shaft and is coupled to the mediating lever through at least a connecting groove formed at the control shaft wherein the connecting groove is biased from rotation axis of the control shaft with a predetermined distance such that the mediating lever can be drawn back or forth by a rotation of the control shaft; and a control unit coupled to the control shaft and controls a rotation angle of the control shaft.

The valve unit may comprise a swing arm including a high lift contact portion and a low lift contact portion.

The output cam may comprise: a low lift activation portion having a profile of the low lift contact portion of the swing arm and positioned near to the control shaft; and a high lift activation portion being substantially thinner than the low lift activation portion and positioned near to the pivot part of the valve unit.

The low lift activation portion of the output cam contacts the low lift contact portion of the swing arm in low lift mode and the high lift activation portion of the output cam contacts the high lift contact portion of the swing by the control device.

The contact points between the swing arm and the output cam for a low lift mode is closer to the control shaft than contact points between the swing arm and the output cam for a high lift is mode.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
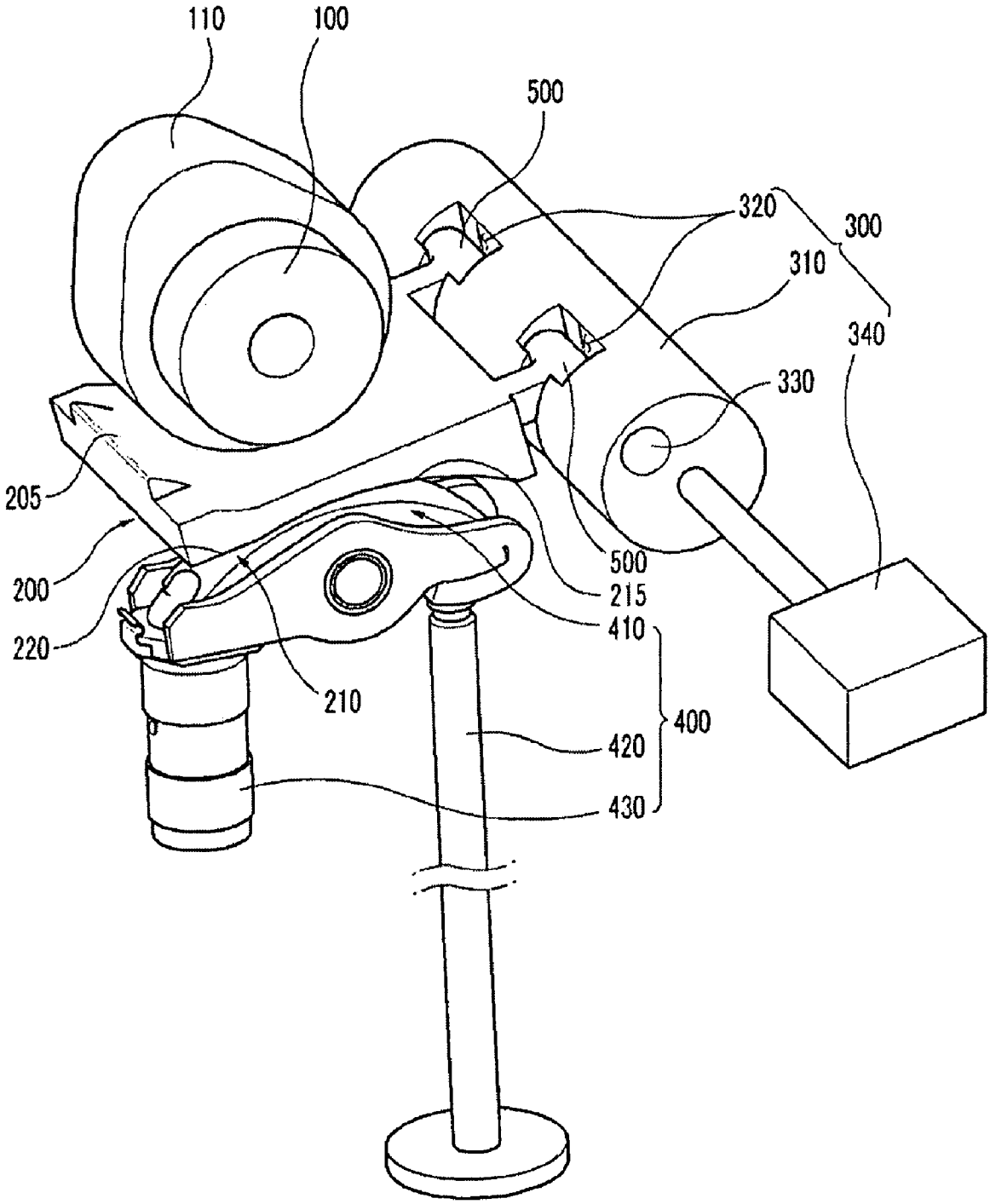
FIG. 1 is a perspective view of a variable valve lift (VVL) apparatus according to an exemplary embodiment of the present invention.

| <Reference Numerals> | |
|---|---|
| 100: input shaft | 110: input cam |
| 200: mediating lever | 205: contact portion |
| 210: output cam | 215: low lift activation portion |
| 220: high lift activation portion | |
| 300: control device | 310: control shaft |
| 320: connecting groove | 330: connecting pin |
| 340: control unit | |
| 400: valve unit | 410: swing arm |
| 414: low lift contact portion | |
| 416: high lift contact portion | |
| 420: valve | 430: valve adjuster |
| 500: pivot portion | |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
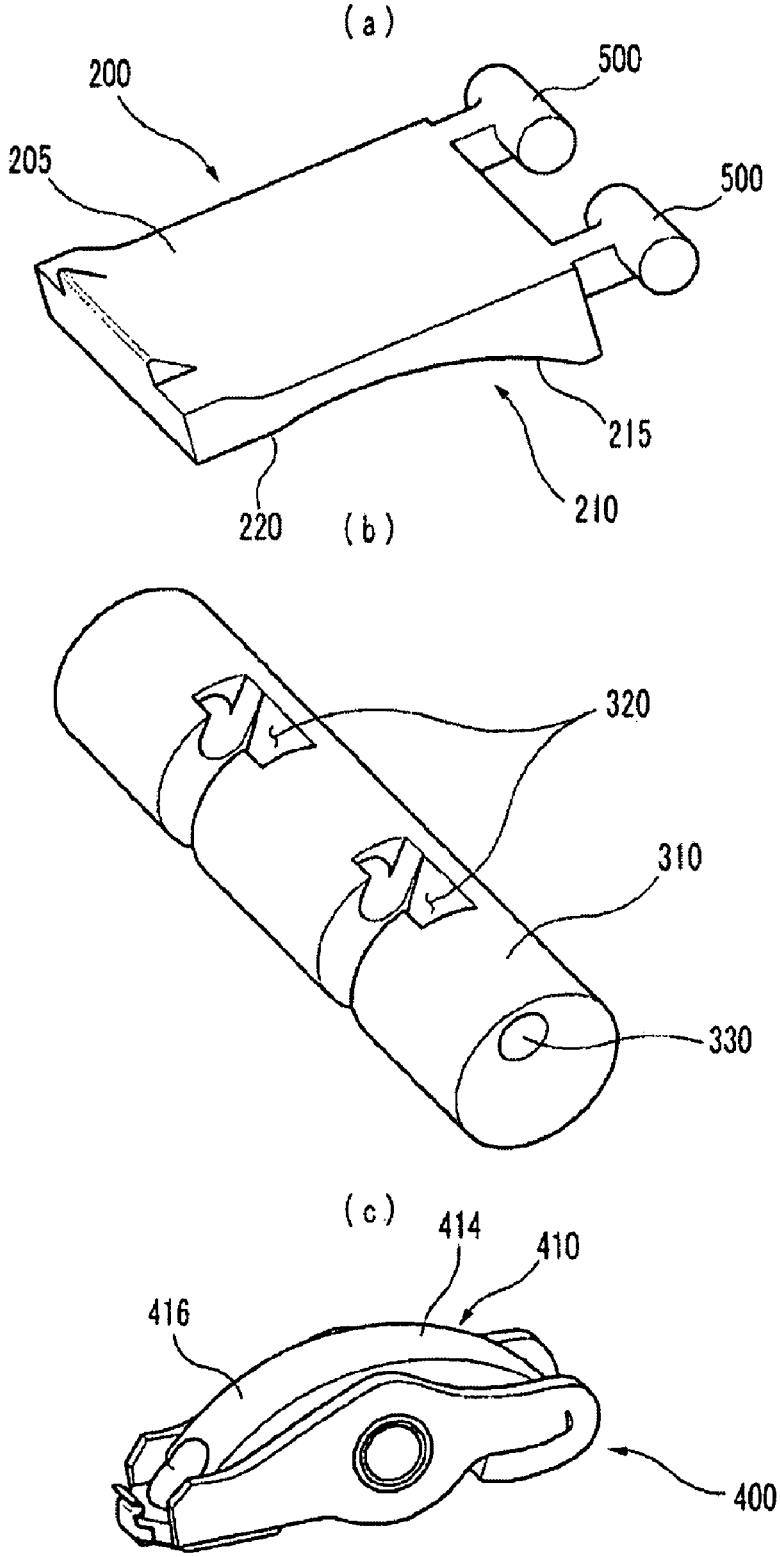
FIG. 2(*a*) to FIG. 2(*c*) respectively illustrate a mediating lever, a control shaft, and a swing arm of a VVL apparatus according to an exemplary embodiment of the present invention.

FIG. 1 is a perspective view of a variable valve lift (VVL) apparatus according to an exemplary embodiment of the present invention. FIG. 2(*a*) to FIG. 2(*c*) respectively illustrate a mediating lever, a control shaft, and a swing arm of a VVL apparatus according to an exemplary embodiment of the present invention.

As shown in FIG. 1 and FIG. 2, a variable valve lift apparatus according to an exemplary embodiment of the present invention includes: an input cam 110 provided on an input shaft 100; a mediating lever 200; a valve unit 400 operated by the mediating lever 200; and a control device 300.

The input cam 110 is coaxially provided on an input shaft 100.

The mediating lever 200 comprises a contact portion 205, an output cam 210, and at least a pivot portion 500.

In an exemplary embodiment of the present invention, the contact portion 205 and the output cam 210 form a single integral combination and the pivot portion 500 is positioned at a distal end of the combination.

The output cam 210 of the mediating lever 200 comprises low lift activation portion 215 and high lift activation portion 220.

The contact portion 205 of the mediating lever 200 contacts with outer profile of the input cam 110 in accordance with high lift more or low lift mode and thus the rotation of the input cam 110 is changed to upward or downward movement of the mediating lever 200 with respect to the pivot portion 500

The valve unit 400 is positioned under the mediating lever 200, i.e., contacts on the output cam 210 of the mediating lever 200, and thus is operated by the upward or downward movement of the mediating lever 200.

The control device 300 includes a control shaft 310 having at least a connecting groove 320 therein and a control unit 340. As an exemplary embodiment of the present invention, rotation axis of the control shaft 310 is aligned in parallel to the rotation axis of the input shaft 100.

The connecting groove 320 is formed at an outer portion of the control shaft 310 and is biased with a predetermined distance from rotation center of the control shaft 310.

Further the connecting groove 320 is sized sufficiently enough to receive the pivot portion 500 of the mediating lever 200.

As an exemplary embodiment, at least a connecting pin 330 may be provided at at least a lateral side of the control shaft 310 to couple the pivot portion 500 of the mediating lever 200 to the control shaft 310. The coupling method of the pivot portion 500 and the control shaft 310 can be variously embodied by a person of ordinary skill in the art and thus detailed explanation is omitted.

The control unit 340 is coupled to a distal end of the control shaft 310. In other words, the control unit 340 is coupled to rotation axis of the control shaft 310 and thus control rotation angle of the pivot portion 500 of the mediating lever 200 with respect to the rotation axis of the control shaft 310 to draw back or forth the mediating lever 200 in accordance with high or low lift mode.

The back and forth movement of the mediating lever 200 changes contact points between the valve unit 400 and the output cam 210 of the mediating lever 200 as explained in detail later.

The control unit 340 may be realized as a step motor. However, the control unit 340 may be driven by an electronic control unit (not shown), which can be easily realized by a person of ordinary skill in the art.

In an exemplary embodiment of the present invention, the valve unit 400 includes a swing arm 410, a valve 420, and a lash adjuster 430.

The swing arm 410 has an oval profile at a surface for contacting the output cam 210 of the mediating lever 200.

The swing arm 410 includes a low lift contact portion 414 and a high lift contact portion 416, wherein the low lift contact portion 414 is activated by the low lift activation portion 215 of the mediating lever 200 in low lift mode and the high lift contact portion 416 is activated by the high lift activation portion 220 of the mediating lever 200 in high lift mode respectively.

In an exemplary embodiment of the present invention, the low lift activation portion 215 of the mediating lever 200 is substantially similar to the profile of the low lift contact portion 414 of the swing arm 410.

However, the high lift activation portion 220 of the mediating lever 200 is substantially linear and thinner than the low lift activation portion 215.

The low lift contact portion 414 is positioned near to the control shaft 310 and the high lift contact portion 416 is positioned opposite to the low lift contact portion 414 with respect to rotation axis of input shaft 100.

First end of the swing arm 410 positioned substantially near to the low lift contact portion 414 is coupled to the valve 420 and second end of the swing arm 410 positioned substantially near to the high lift contact portion 416 is pivotally coupled to the lash adjuster 430.

The second end of the swing arm 410 pivotally coupled to the lash adjuster 430 is positioned opposite to the pivot portion 500 of the mediating lever 200 with respect to the rotation axis of the input shaft 100.

From this configuration, lift length of the valve 420 can be controlled by the back and forth movement of the mediating lever 200 so that the valve 420 may be opened or closed by the rotation of the swing arm 410 in accordance with high lift mode or low lift mode as explained.

Hereinafter, an operation of a variable valve lift apparatus according to an exemplary embodiment of the present invention is described in detail with reference to FIG. 3 and FIG. 4 in accordance with high or low lift mode.

Figure 3:
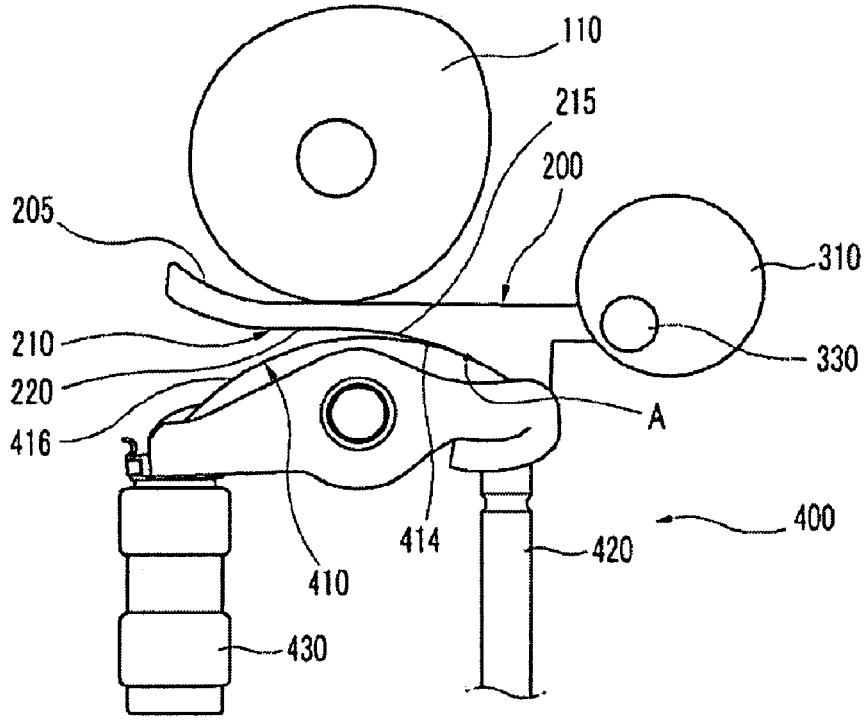
FIG. 3 illustrates a low lift mode of an operation of a variable valve lift apparatus according to an exemplary embodiment of the present invention.
Figure 3:
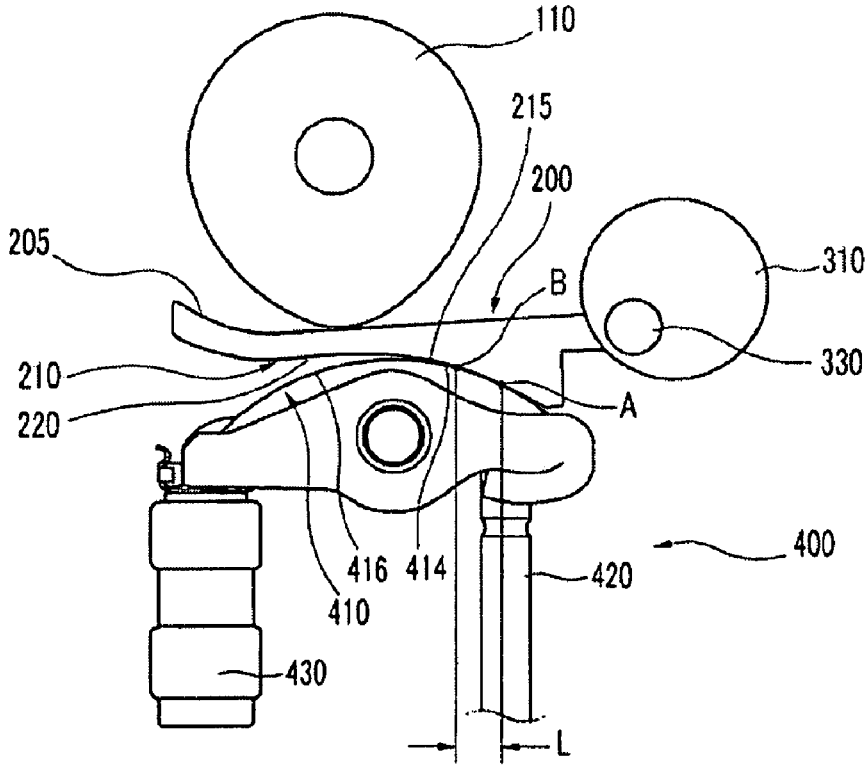

FIG. 3 illustrates a low lift mode of an operation of a variable valve lift apparatus according to an exemplary embodiment of the present invention. FIG. 4 illustrates a high lift mode of an operation of a variable valve lift apparatus according to an exemplary embodiment of the present invention.

Contact points between the swing arm 410 and the output cam 210 of the mediating lever 200 are changed by the rotation of the control shaft 310 in accordance with high or low lift mode. In more detail, contact points between the swing arm 410 and the output cam 210 of the mediating lever 200 for a low lift mode are positioned closer to the control shaft 310 than contact points between the swing arm 410 and the output cam 210 for a high lift are.

In the low lift mode as shown in FIG. 3, the control unit 340 of the control device 300 rotates the control shaft 310 to move the mediating lever 200 toward the control shaft 310 so that the low lift activation portion 215 of the output cam 210 and the low lift contact portion 414 of the swing arm 410 substantially contact each other at a point between a point A and a point B, i.e., in a range L, wherein the points A and B are positioned close to the rotation axis of the control shaft 310.

In more detail, at a base state in the low lift mode, a base circle of the input cam 110 contacts the contact portion 205 of the mediating lever 200, and then the output cam 210 of the mediating lever 200 contacts the swing arm 410 at the contact point A of the low lift contact portion 414.

Further as the input cam 110 rotates until the mediating lever 200 is fully pushed downwards as shown in FIG. 3(*b*), the contact point moves from the point A to the point B of the low lift contact portion 414.

As a result, since the vertical travel distance of the mediating lever 200 at the contact range L is small and the contact range L is positioned far from the second end of swing arm 410 that is pivotally supported by the lash adjuster 430, the rotational displacement of the first end of the swing arm 410 that is coupled to the valve 420 is small. Therefore, a low lift of the valve 420 is realized.

Figure 4:
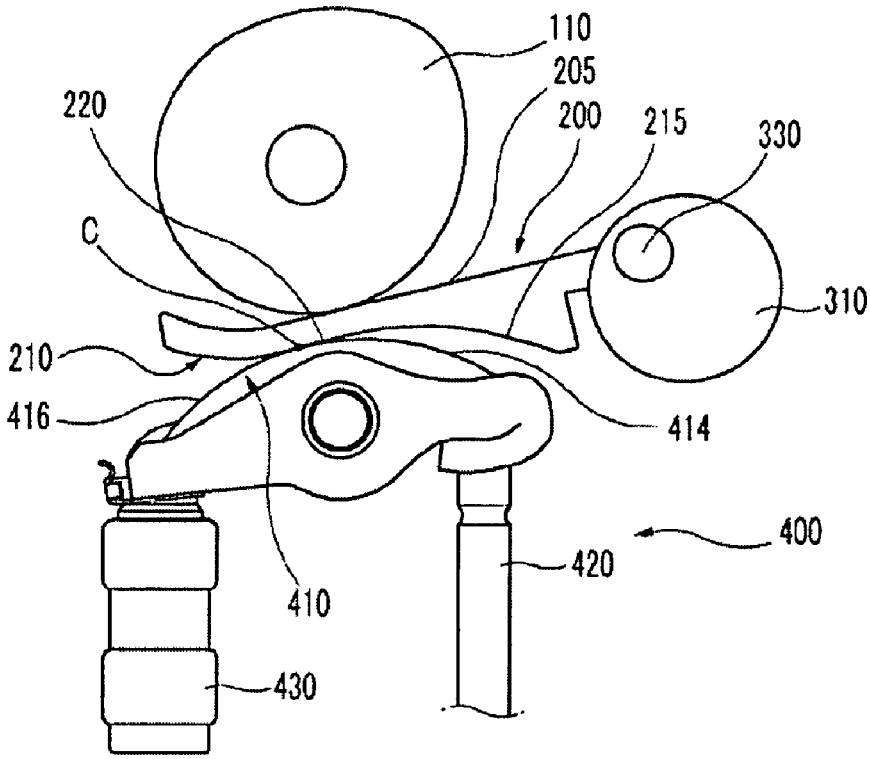
FIG. 4 illustrates a high lift mode of an operation of a variable valve lift apparatus according to an exemplary embodiment of the present invention.
Figure 4:
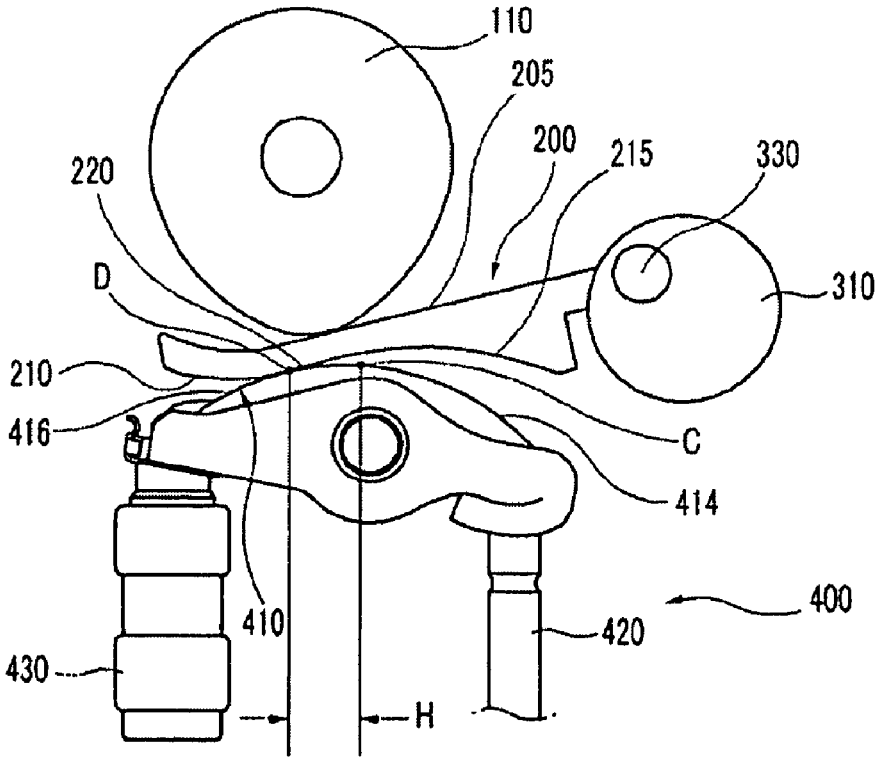

In contrast, in the high lift mode, as shown in FIG. 4, the high lift activation portion 220 of the output cam 210 and the high lift contact portion 416 of the swing arm 410 contact each other at a point between a point C and a point D, i.e., in a range H on the high lift contact portion 416 of the swing arm 410.

In more detail, at a base state in the high lift mode as shown in FIG. 4(*a*), a base circle of the input cam 110 contacts an upper surface of the mediating lever 200, and the high lift activation portion 220 of the output cam 210 contacts the high lift contact portion 416 of the swing arm 410 at the contact point C.

As the input cam 110 rotates until the mediating lever 200 is fully pushed downward as shown in FIG. 4(*b*), the contact point moves from the point C to the point D on the high lift contact portion 416 of the swing arm 410.

Since the contact range H is near to the second end of swing arm 410 that is pivotally supported by the lash adjuster 430, the small vertical travel distance of the mediating lever 200 at the contact range H can amplify the rotational displacement of the swing arm 410 such that the movement of the valve 420 becomes large. Therefore, a high lift of the valve 420 is realized.

In the above description, only two lifts of the valve has been described for case of understanding, however, it may be understood that the valve lift can be continuously varied since the control shaft 310 can be continuously rotated to an arbitrary angle by the control unit 340.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A continuously variable valve lift apparatus, comprising:
an input cam provided on an input shaft;
a mediating lever that reciprocally moves by the input cam and is formed with an output cam:
a valve unit operated by the output cam; and
a control device that is coupled to the mediating lever and is capable of changing a contact point between valve unit and the output cam of the mediating lever;
wherein the control device comprises:
a control shaft that is arranged substantially in parallel with the input shaft and is coupled to the mediating lever through at least a connecting groove such that the mediating lever is drawn back or forth by a rotation of the control shaft; and
a control unit that controls a rotation angle of the control shaft.

2. The continuously variable valve lift apparatus of claim 1, wherein the connecting groove is eccentrically biased from a rotation center of the control shaft.

3. The continuously variable valve lift apparatus of claim 1, wherein the valve unit comprises a swing arm having an oval profile at a surface for contacting the output cam of the mediating lever.

4. The continuously variable valve lift apparatus of claim 3, wherein a contact point between the swing arm and the output cam for a low lift is closer to the control shaft than a contact point between the swing arm and the output cam for a high lift is.

5. A continuously variable valve lift apparatus, comprising:
an input cam coaxially provided on an input shaft;
a mediating lever comprising contact portion, output cam, and at least a pivot portion wherein the input cam contacts on the contact portion, and the contact portion and the output cam rotates pivotally with respect to the pivot portion in response to rotation of the input cam;
a valve unit operated by the output cam of the mediating lever, comprising a pivot part, wherein the pivot part is positioned opposite to the pivot portion of the mediating lever with respect to rotation axis of the input shaft; and a control device that is coupled to the pivot portion of the mediating lever and changes a contact point between valve unit and the output cam of the mediating lever;

wherein the control device comprises:

a control shaft that is arranged in parallel with the input shaft and is coupled to the mediating lever through at least a connecting groove formed at the control shaft wherein the connecting groove is biased from rotation axis of the control shaft with a predetermined distance such that the mediating lever can be drawn back or forth by a rotation of the control shaft; and a control unit coupled to the control shaft and controls a rotation angle of the control shaft.

6. The continuously variable valve lift apparatus of claim 5, wherein the valve unit comprises a swing arm including a high lift contact portion and a low lift contact portion.

7. The continuously variable valve lift apparatus of claim 6, wherein the output cam comprises:

a low lift activation portion having a profile of the low lift contact portion of the swing arm and positioned near to the control shaft; and a high lift activation portion being substantially thinner than the low lift activation portion and positioned near to the pivot part of the valve unit.

8. The continuously variable valve lift apparatus of claim 7, wherein the low lift activation portion of the output cam contacts the low lift contact portion of the swing arm in low lift mode and the high lift activation portion of the output cam contacts the high lift contact portion of the swing by the control device.

9. The continuously variable valve lift apparatus of claim 5, wherein contact points between the swing arm and the output cam for a low lift mode is closer to the control shaft than contact points between the swing arm and the output cam for a high lift is mode.

* * * * *